US010066419B2

(12) United States Patent
van Buynder

(10) Patent No.: US 10,066,419 B2
(45) Date of Patent: Sep. 4, 2018

(54) CYLINDER LOCK AND COMBINATION OF SUCH A LOCK AND KEY

(71) Applicants: Benny Omer Rosa van Buynder, Sint-Niklaas (BE); T.E.L. Mulder, Heijen (NL); Almotec B.V., Oostrum-Venray (NL)

(72) Inventor: Benny Omer Rosa van Buynder, Sint-Niklaas (BE)

(73) Assignees: Almotec B.V., Oostrum, Venray (NL); T.E.L. Mulder, Heijen (NL)

( * ) Notice: Subject to any disclaimer, the term of this patent is extended or adjusted under 35 U.S.C. 154(b) by 46 days.

(21) Appl. No.: 14/649,324

(22) PCT Filed: Dec. 23, 2013

(86) PCT No.: PCT/EP2013/077876
§ 371 (c)(1),
(2) Date: Jun. 3, 2015

(87) PCT Pub. No.: WO2014/096442
PCT Pub. Date: Jun. 26, 2014

(65) Prior Publication Data

US 2015/0300043 A1 Oct. 22, 2015

(30) Foreign Application Priority Data

Dec. 23, 2012 (EP) ..... 12199314

(51) Int. Cl.
*E05B 27/08* (2006.01)
*E05B 27/00* (2006.01)
(Continued)

(52) U.S. Cl.
CPC ..... *E05B 27/08* (2013.01); *E05B 19/00* (2013.01); *E05B 27/0003* (2013.01);
(Continued)

(58) Field of Classification Search
CPC ..... E05B 27/08; E05B 19/00; E05B 27/0003; E05B 27/0042; E05B 47/063;
(Continued)

(56) References Cited

U.S. PATENT DOCUMENTS 3,889,501 A * 6/1975 Fort ..... E05B 47/063 361/172
4,277,962 A * 7/1981 Lipschutz ..... E05B 17/147 70/423
(Continued)

FOREIGN PATENT DOCUMENTS

CN 202359889 U 8/2012
DE 10045631 A1 1/2002
(Continued)

*Primary Examiner* — Suzanne L Barrett
(74) *Attorney, Agent, or Firm* — Richard M. Goldberg

(57) ABSTRACT

A cylinder lock includes a housing; a cylinder rotatably provided therein and having first and second ends, the cylinder extending in a longitudinal direction between the first and second ends and including an internal keyway for placing a key corresponding to the lock in the cylinder; a locking mechanism that prevents rotation of the cylinder with respect to the housing when the key is not present in the keyway; a blocking element positioned between the first and second end, and configurable to take a first position wherein the keyway is blocked such that the key cannot be placed in the keyway and a second position wherein the keyway is unblocked such that the key can be placed therein; a configuration device to configure the blocking element in the first or second position, and controllable by wireless communication between the lock and a remote control unit.

12 Claims, 5 Drawing Sheets

(51) Int. Cl.
*E05B 47/06* (2006.01)
*E05B 19/00* (2006.01)
*G07C 9/00* (2006.01)

(52) U.S. Cl.
CPC ..... *E05B 27/0042* (2013.01); *E05B 47/063* (2013.01); *G07C 9/00309* (2013.01); *E05B 47/0634* (2013.01)

(58) Field of Classification Search
CPC ..... E05B 47/0634; E05B 47/0012; E05B 47/0005; E05B 19/04; E05B 47/0603; E05B 47/0692; E05B 47/0626; E05B 19/26; E05B 47/0607; E05B 47/0611; G07C 9/00309; G07C 2009/00992; Y10T 70/7102; Y10T 70/7599; Y10T 70/7136; Y10T 70/7051; Y10T 70/7977; Y10T 70/7955
USPC ..... 70/278.3, 427
See application file for complete search history.

(56) References Cited

U.S. PATENT DOCUMENTS 4,490,998 A 1/1985 Wellekens
4,789,859 A * 12/1988 Clarkson ..... E05B 47/063 235/382
4,848,115 A * 7/1989 Clarkson ..... E05B 47/063 361/172
4,854,146 A * 8/1989 O'Connell ..... E05B 17/04 70/277
5,083,362 A * 1/1992 Edgar ..... B23P 11/00 29/509
5,469,727 A * 11/1995 Spahn ..... G07C 9/00309 340/5.65
5,507,162 A * 4/1996 Chhatwal ..... E05B 17/22 340/5.64
5,691,711 A * 11/1997 Jorgensen ..... E05B 49/002 340/5.67
5,836,187 A * 11/1998 Janssen ..... B60R 25/04 70/252
6,035,677 A 3/2000 Janssen et al.
6,318,137 B1 * 11/2001 Chaum ..... E05B 49/002 340/5.67
6,363,762 B1 * 4/2002 Kueng ..... E05B 47/063 70/278.3
6,442,986 B1 * 9/2002 Russell ..... E05B 47/063 70/278.3
6,526,791 B2 * 3/2003 Shvarts ..... E05B 9/084 70/409
6,840,072 B2 * 1/2005 Russell ..... E05B 47/063 70/278.3
7,640,773 B2 * 1/2010 Bellamy ..... E05B 17/0062 70/278.3
7,673,484 B1 3/2010 Crepinsek
7,696,878 B2 * 4/2010 Cable ..... G07C 9/00182 307/10.3
8,581,690 B2 * 11/2013 Lappalainen ..... E05B 47/0611 340/3.1
8,720,238 B1 * 5/2014 Davis ..... E05B 43/005 70/278.7
8,866,066 B2 * 10/2014 Fuse ..... E05B 49/006 250/231.1
8,899,081 B2 * 12/2014 Pukari ..... E05B 47/0012 70/277
8,928,453 B2 * 1/2015 Sprenger ..... G07C 9/00111 307/9.1
2002/0116968 A1 * 8/2002 Shvarts ..... E05B 9/084 70/370
2006/0156771 A1 * 7/2006 Hauri ..... E05B 47/0649 70/278.7
2006/0230796 A1 * 10/2006 Keller ..... G07C 9/00944 70/278.3
2008/0053174 A1 3/2008 Amir

FOREIGN PATENT DOCUMENTS

DE 102004055979 A1 5/2006
DE 102011014797 B3 3/2012
EP 0709533 A2 5/1996
EP 1013856 A1 6/2000
FR 2785322 A1 5/2000
GB 775098 5/1957

* cited by examiner

CYLINDER LOCK AND COMBINATION OF SUCH A LOCK AND KEY

FIELD OF THE INVENTION

The present invention pertains to a cylinder lock comprising a housing and rotatably provided therein a cylinder having a first end and a second end, the cylinder extending in a longitudinal direction between the first end and the second end, the cylinder comprising an internal keyway for placing a key corresponding to the lock in the cylinder, the lock further comprising a locking mechanism that prevents rotation of the cylinder with respect to the housing when the key is not present in the keyway. The invention also pertains to a combination of such a lock and a corresponding key.

BACKGROUND OF THE INVENTION

A cylinder lock is a lock constructed with a cylinder that is able to rotate with respect to a housing along a so-called shear line, however in principal only when a corresponding key (or at least the blade thereof) is placed in the keyway. The housing is stationary with respect to the door or other item that can be locked. The cylinder by rotating, optionally by actuating a cam, is used to change the position of the actual locking element such as a bar of metal that actually secures the position of the element to be locked (typically a door). A locksmith can easily unscrew the cylinder to facilitate rekeying. The cylinder may contain any of a variety of locking mechanisms, including commonly known mechanisms such as the pin tumbler lock, the wafer tumbler lock and the disc tumbler lock. Any of these locks may be designed for any known type of key such as a cut key (having saw tooth like bitings), a dimple-key, tubular key (for so called radial locks), skeleton key, Zeiss key (also known as cruciform key), Abloy key, magnetic key etc. These keys may be single- or multiple sided as known in the art.

The first main advantage to a cylinder lock, also described as a profile cylinder lock, is that the cylinder may be changed without altering the boltwork hardware. Removing the cylinder typically requires only loosening a set screw, then unscrewing the cylinder from the boltwork. The second is that it is usually possible to obtain, from various lock manufacturers, cylinders in different formats that can all be used with the same type of key. This allows the user to have keyed-alike, and master-keyed systems that incorporate a wide variety of different types of lock, such as night latches, deadbolts and roller door locks. Typically, padlocks can also be included, although these rarely have removable cylinders. Standardised types of cylinder include key-in-knobset cylinders, rim (also known as night latch) cylinders, Ingersoll format cylinders, American, and Scandinavian round mortise cylinders, and Scandinavian oval cylinders. There are also standardised cross-sectional profiles for lock cylinders that may vary in length—for example to suit different door thicknesses. These profiles include the europrofile (or DIN standard), the British oval profile and the Swiss profile.

Cylinder locks however are vulnerable to forced entry by various techniques used in the art of burglary and law enforcement. Conventional cylinders can be easily drilled to create another shear line to allow the cylinder to turn freely without a key or to totally remove the internal components of the cylinder, whereafter a screwdriver can be used to rotate the cam. Another technique aims at pulling a cylinder from its housing. In this technique a special hardened screw is inserted into the keyway, and then an extreme pulling force is applied with a tool to exert reverse pressure against the door. This is a simple technique for which even commercial sets are available. Yet another technique is commonly referred to as a twisting attack. This technique relies on torsion and twisting forces that can be applied to a screwdriver or alike that is inserted deep enough into the keyway. A torque as great as 600 pound-inches can be easily applied by using a common adjustable wrench. This way, the lock can be broken allowing removal of the cylinder.

Yet another commonly applied technique uses a co-called bumpkey to bump a lock. When bumping a lock, a key that mechanically fits the key way such that it can at least be inserted in the cylinder, is initially inserted into the keyway one pin short of full insertion. Bumping the key inward forces it deeper into the keyway. The specially designed teeth of the bump key transmit a slight impact force to all of the bottom pins in the lock. The key pins transmit this force to the driver pins; the key pins stay in place. Because the pin movements are highly elastic, the driver pins "jump" from the key pins for a fraction of a second, moving higher than the cylinder (i.e. the shear line), then are pushed normally back by the spring to sit against the key pins once again. Even though this separation only lasts a split second, if a light rotational force is continuously applied to the key during the slight impact, the cylinder will turn during the short separation time of the key and driver pins, and the lock can be opened while the driver pins are elevated above the keyway. Lock bumping takes only an instant to open the lock and the lock is usually not visibly damaged.

Impressioning is yet another non-destructive, covert method of creating a working key for a lock without picking or disassembly. Impressioning is one of the most useful skills in locksmithing, and is divided between copying and manipulation techniques. Copying focuses on making negative-image moulds of a source key, while manipulation uses various techniques to determine the proper heights of internal components without the source key being available. For the latter method, it is needed that a blank key is slided into the key. Impressioning via manipulation is closely related to decoding. Many high profile crimes have been accomplished through the use of impressioning techniques.

Pin tumbler locks are vulnerable to lockpicking. This technique involves a pick, which is a thin piece of hard steel with a small hook at its end, and some other tool (typically a tension wrench) that can be inserted into the keyhole alongside the pick and used to rotate the cylinder. The technique relies on small imperfections in the cylinder, that lead to a single pin holding the cylinder from rotating. The burglar applies a constant (though weak) torque on the cylinder with a wrench, and tries the pick at each pin.

When the pick fiddles with the pin that actually holds the cylinder, the cylinder will rotate minutely, until another pin will stop it. Now the first pin is held in open position by the cylinder itself, and the burglar can proceed to pick the other keypin. Though these principals are easy to understand, in practice a great deal of experience and patience is required in order to master this technique. Very high quality cylinders are less prone to this attack, requiring more time as well as superior skill, however, electronic locks are far cheaper and robust just as well.

Manual and electronic pick guns are a popular method used today for quick and easy ways of opening doors. The higher-end electric pick guns are usually made of aircraft aluminum and hard steel. The pick is operated by simply pressing a button that vibrates while the normal tension wrench is being used. A manual pick gun (or Snap gun) is used in a similar way but usually has a trigger that creates a movement which (like bump keys) operates on the same principle as Newton's cradle. It transfers sudden energy to the key pins which communicate this to the driver pins causing those pins only to jump, allowing the cylinder to turn freely for a brief moment, until the pin springs return the pins to their locking position. A pick gun is used in conjunction with a tension tool and the only skill required here is learning the timing.

Various locks with additional means to protect the lock against forced entry have been described in the art.

GB 775,098 shows a pin tumbler lock with an additional security feature in the form of a plunger normally resiliently loaded to an unlocking position where it is housed within the cylinder but axially movable from said unlocking position to a locking position bridging the housing and the cylinder, by plunger operating formations on the side of the key. This includes a bevelled side face on the leading end of the key adapted to engage the plunger and move it to a locking position.

U.S. Pat. No. 4,490,998 describes a tamper resistant cylinder lock including a pair of cooperating keyway guard plates, each of which has a keyway formed therethrough. The guard plates are laterally displaceable relative to one another for movement between an open position in which the keyways of the guard plates are aligned to allow for passage of a key, and a blocked position in which the keyway of one of the guard plates is at least partially blocked by the other one of the plates. A uniquely configured key is needed for use in combination with such guard plates.

Likewise, FR 2785322 discloses a tamper resistant cylinder lock including a pair of cooperating keyway guard plates, each of which has a keyway formed therethrough. The configuration of one of the guard plates is controlled using a configuration mechanism that is controllable by wireless communication between the lock and a remote control unit.

U.S. Pat. No. 7,673,484 discloses a pin tumbler lock which in addition to the pin tumbler locking means, is provided with a block assembly to prevent the cylinder from rotating with respect to the housing. This provides additional means for preventing the lock to be tampered.

DE 10 2004 055979 discloses a cylinder lock which in addition to the commonly known multiple locking pins to prevent rotation of the cylinder in the housing, which elements can be controlled by inserting a fitting key, has an extra locking pin to prevent rotation of the cylinder in the housing. This additional pin can be controlled via wireless communication. This way, the insertion of a (mechanical) fitting key alone in the keyway is not sufficient to allow rotation of the cylinder in the housing, a further actuation is needed to retract the additional element from its blocking position into a position where rotation of the cylinder is allowed. This way, although the entry of a non-allowed key cannot be prevented, even if this non-allowed key is fully inserted in the keyway, the rotation of the cylinder will still be blocked if the required further actuation of the additional locking pin is not provided.

SUMMARY OF THE INVENTION

It is an object of the invention to provide a cylinder lock that is better resistant against unwanted unlocking (forced entry) and optionally vandalism. To this end, a lock as mentioned above under "Field of the invention" is devised, characterised in that the lock comprises a blocking element positioned between the first and second end, which blocking element is configurable to take a first position wherein the keyway is blocked (such that the key cannot be placed in the keyway) and a second position wherein the keyway is unblocked (such that the key can be placed therein), wherein the lock comprises a configuration means to configure the blocking element in the first or second position, wherein the configuration means is (optionally) controllable by wireless communication between the lock and a remote control unit. The invention is also embodied in a combination of such a cylinder lock and a key that corresponds to the said lock, wherein the key is provided with a transmitter and the lock is provided with a receiver, the said transmitter and receiver enable the wireless communication. The invention also pertains to a key provided with a transmitter for use in combination with a cylinder lock as described here above.

With this invention a lock is provided having an internal blocking element to prevent a key or other key-shaped element to be placed in the cylinder, which blocking element is configurable using a remote control unit. So even a key that mechanically corresponds to the locking mechanism itself (for example a true mechanical copy of the original key), cannot by placed in the cylinder if the blocking element is configured in the first (blocking) position. Since the blocking element is not positioned in front of the cylinder (i.e. externally of the cylinder) it is far less prone to tampering therewith. Prior art blocking elements such as guard plates known from U.S. Pat. No. 4,490,998 and FR 2785322 cannot be positioned internally of the cylinder (at a position corresponding to the locking mechanism) since the presence of such a plate would prevent the key from being able to turn around. Such guard plates can only be used if the complete blade is to pass the guard plate, i.e. by positioning them in front of the cylinder. This positioning makes them inherently vulnerable for tampering therewith. Other blocking elements, such as the blocking element known from DE 10 2004 055979 cannot prevent that a non-allowed key or other object is positioned completely in the keyway. Therefore, such a blocking element cannot prevent that common burglar means that rely on entry of an object into the keyway, such as for example the twisting attack, can still successfully be used.

It is noted that for additional security, the present invention could be used in conjunction with a further means that is used to control the blocking means such as for example a biometric scanner, a card reader etc. Depending on the required level of security, in order to configure the blocking means it could for example be required that the original key with a chip is used to wirelessly contact the configuration means and that additionally, the user of the key is identified as a registered user via a scan of his or her iris and/or fingerprint.

Definitions

Placing a key providing the key to take a position that enables unlocking of the locking mechanism of the lock. In other words, the terms describe fully entering the key (i.e. at least the relevant part of its blade) in the cylinder to an unlocking position.

To block: to stop or impede the passage of or movement through, to obstruct.

Configurable: to bring in a predetermined position in space.

Wireless communication: is transmittal of data between a transmitter and a receiver involving for at least part of the track between the transmitter and receiver a transmission without using a wire to guide the data. Typical wireless communication involves radio, light or sound signals.

To control: to exercise substantial influence over

To extend in a direction: to at least partly extend in that direction. That is, when a line A crosses a line B, line A extends in a direction perpendicular to line B.

Embodiments of the Invention

In an embodiment the blocking element in the first position prevents rotation of the cylinder with respect to the housing. In this embodiment the blocking element, together with the locking mechanism may prevent rotation of the cylinder with respect to the housing. This way, the blocking element does not only provide protection against an element (such as a false key) being driven into the keyway of the lock, it also provides additional strength against the cylinder being forced to turn into its housing while being in the blocked position.

In another embodiment the blocking element is peg-shaped. A peg-shaped element has found to be less prone to mechanical tampering than for example plate-shaped blocking elements. A peg, in particular when made of a hardened material, can hardly be drilled trough or otherwise be mechanically worked. In a preferred embodiment the peg-shaped blocking element extends in a direction perpendicular to the longitudinal direction in which the cylinder extends, which will further increase the difficulty to mechanically impact the blocking element from a position outside of the lock.

In an embodiment wherein the locking mechanism comprises multiple pins, the blocking element and each of the pins are of congruent shape. This embodiment advantageously recognises that the current invention can easily be conformed in existing type of pin tumbler locks when the blocking element simply takes the place of any (or more) of the original pins. A position adjacent the entry of the keyway provides optimal protection against any unwanted object being put in the keyway. A position more towards the middle portion of the cylinder reduces the risk of the blocking element being mechanically tampered with. Depending on the type of object to be locked, the techniques of the regional burglars and other things, an optimum type of position can be chosen.

In yet another embodiment the blocking element is configurable by translation in a direction perpendicular to the longitudinal direction in which the cylinder extends. In this embodiment, the blocking element is translated to reach any of the blocked and open positions. A translation can be provided simply by using common technical means such as for example screw thread, a toothed bar, electro-magnetic means etc. This embodiment is particularly useful for the type of locks having a housing for the locking mechanism that extends substantially over the same length as the cylinder itself. The blocking element can then be placed inside that part of the housing that keeps the locking mechanism. Then, the blocking element even when being in the second (open) position, thus translated out of the actual cylinder, is still within a mechanically strong housing and thus protected from mechanical violence.

In an alternative embodiment the blocking element is configurable by rotation about an axis that extends in a direction perpendicular to the longitudinal direction in which the cylinder extends. This embodiment is particularly useful for so called Swiss-type locks where the part of the housing that keeps the locking mechanism extends only along a middle portion of the cylinder. In order to keep the blocking element protected from mechanical tampering therewith, even when positioned near the entry of the keyway, it is be placed rotatably in the cylinder. By rotating, an open passage present in the blocking element can either be configured in line with the keyway (in which case a key can pass the blocking element) or transverse thereto (in which case a key cannot pass the blocking element).

In an embodiment the lock comprises a power source to provide the power to actuate the configuration means. Such a power source can be as simply as a built-in Li-ion battery, but any type of power source, being for example electrically, mechanically or a combination thereof may be appropriate. In a further embodiment the blocking element takes a default position when the power source has a power to actuate the configuration means below a predetermined minimum level. In this embodiment, it is prevented that the lock cannot be opened anymore since the power has reached a level that is no longer sufficient to configure the blocking element to take the default position. At the minimum predetermined amount of power, the level should be such that there is at least sufficient power to re-configure the blocking element one more time, i.e. to take the default position. In yet a further embodiment the default position is the second position. In this embodiment the lock will be available for opening with a suitable key, even when the power source is empty, and thus the blocking mechanism can no longer be configured.

In an embodiment the remote control unit is operatively connected to the key. In this embodiment the key may be a so-called transponder key or chip key, or use is made of a separate remote control that is kept together with the key. In principal, any kind of wireless communication signals may be used in the present invention. Common signals make use of light, sound or radio-waves. It is preferable that the signals are so weak that they will not travel significantly further than 4 or 5 centimeters such that unwanted picking up of the signals is practically prevented.

In another embodiment the key is provided with a transmitter that is able to send a signal to provide said communication. In particular, the transmitter is an RFID (radio frequency identification) chip. The RFID chip is also known as an "electronic label," "transponder" or "code plate," and is commonly attached to an antenna. Transmitting in the kilohertz, megahertz and gigahertz ranges, the chip may be battery-powered or derive its power from the RF waves coming from the reader, present in conjunction with the lock. Like bar codes, RFID tags identify items. However, unlike bar codes, which must be in close proximity and line of sight to the scanner for reading, RFID tags do not require line of sight and can be embedded within packages such as the handle of the key.

It is noted that the invention also pertains to a cylinder lock comprising a housing and rotatably provided therein a cylinder that comprises an internal keyway for placing a key corresponding to the lock in the cylinder, the lock further comprising a locking mechanism that prevents rotation of the cylinder with respect to the housing when the key is not present in the keyway, the locking mechanism comprising multiple separate locking elements wherein the lock comprises a blocking element positioned in lieu of one of the said locking elements, which blocking element is configurable to take a first position wherein the keyway is blocked and a second position wherein the keyway is unblocked, wherein the lock comprises a configuration means to configure the blocking element in the first or second position. In this embodiment, a classical type of cylinder lock is used as a basis for the application of the invention, viz. a cylinder lock which has multiple separate locking elements, typically locking pins. One of the multiple separate locking elements is replaced by the blocking means of the invention to provide a cylinder lock according to the invention. This way, the cylinder lock according to the invention can be used in the corresponding existing configuration of the lock that was used to apply the invention in.

In a further embodiment the blocking element is positioned in lieu of the locking element that is situated adjacent an entrance of the keyway, i.e. at a position most near to the entrance of the keyway for any of the locking element positions. This way, the keyway can be blocked at the entrance site which minimizes the risk of unwanted entrance of an object or (fluid or gaseous) material in the keyway. It is noted that any of the above described embodiments (which relate to dependent claims 2 to 12) can also be applied in the lock according to these two embodiments of the invention.

The invention also pertains to a key for use with a cylinder lock according to the invention, wherein the key is made of a synthetic material (thus not of metal, or a metal alloy) and comprises a chip for enabling the wireless communication, the chip being embedded in the material. Synthetic materials such as plastics, (UV curable) resins and other materials that are able to be moulded at temperatures below 250° C., in particular below 200° C., below 190° C., below 180° C., below 170° C., below 160° C. or below 150° C., have the advantage that the chip can be easily embedded in the material of the key itself (currently, chips are available that can withstand temperatures as high as 250° C.; RFID chips typically can withstand temperatures up to 200° C.). With a traditional key which has a metal blade, the chip has to be positioned adjacent the handle of the key and is thereafter enclosed by a plastic or rubber enclosure. Such keys are often relatively thick, heavy and are prone to easy damage to the enclosure. A key made of a synthetic material can be very flat and light and still enclose a chip, preferably completely embedded in the material. In an embodiment the chip is provided in the blade of the key, preferably near the distal end of the blade. Being present near the distal end of the blade, thus near the key tip, means the chip will be able to communicate wireless with a lock, a fraction of a second earlier then in a situation where the chip is present in the handle of the key. Even during everyday use, a fraction of a second may be noticeable when opening the lock.

The invention will now be explained in more detail using the following non-limiting examples.

DETAILED DESCRIPTION

FIG. 1

Figure 1:
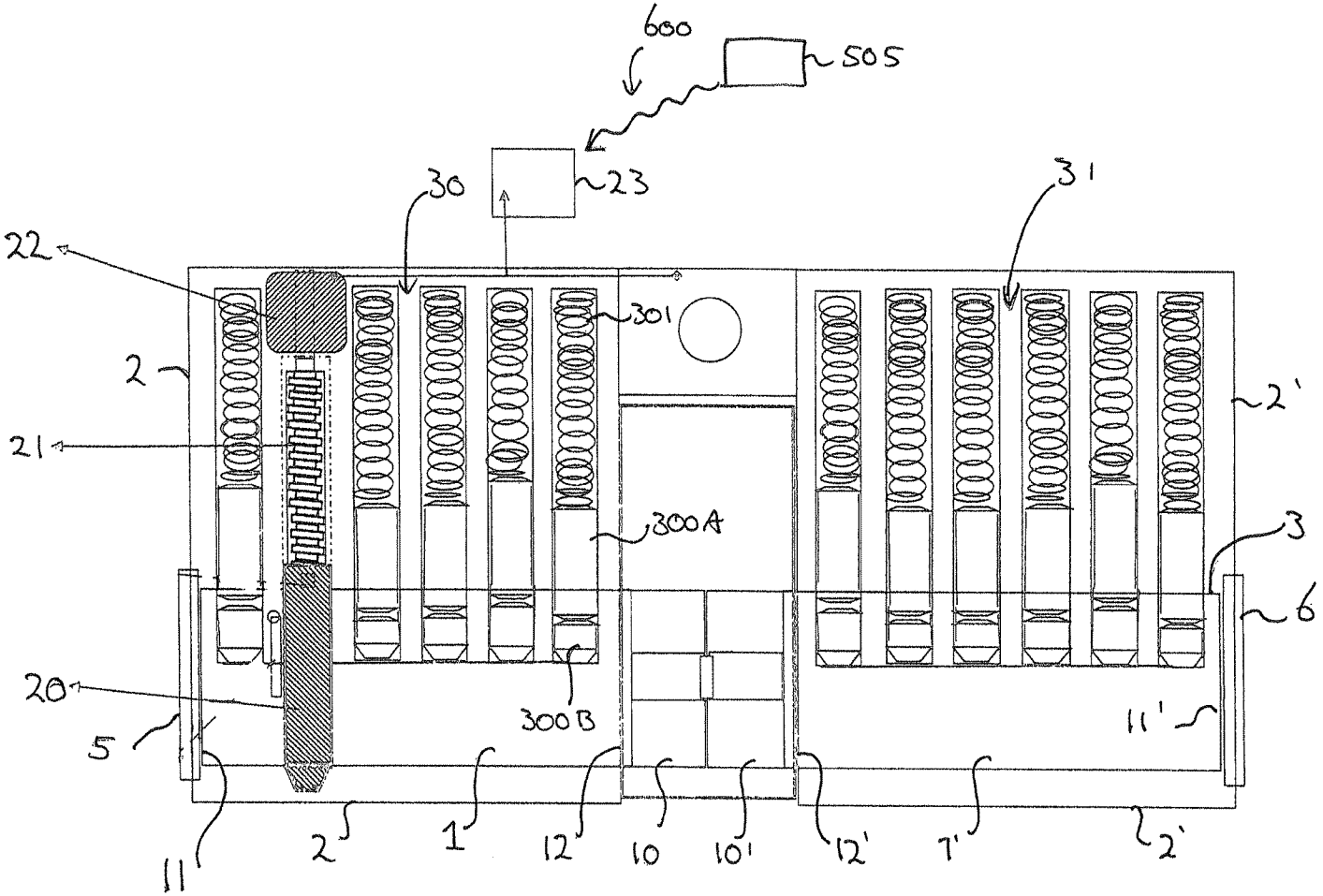
FIG. 1 schematically shows a cross-sectional view of a double cylinder lock

FIG. 1 schematically shows a cross-sectional view of the essential parts of a double cylinder lock according to the invention, the lock having a first entrance 5 for a key on one side (the outside in this embodiment), and a second entrance 6 on the other side of the lock (the inside). This lock is provided in a house-door (not shown), that may open and close in a frame (not shown). The actual closing element to lock the door, when closed, in the frame is in this case a metal projection in the form of a solid bar (as is commonly known) that can be forced to leave the lock and project into a reinforced opening of the frame. The lock comprises two cylinders 1 and 1' which extend between their respective first and second ends 11 and 12 and 11' and 12'. Each cylinder is rotatably provided in its respective housing 2 and 2'. Upon rotating each cylinder the cams 10 and 10' respectively are driven to rotate and actuate the actual closing element as referred to here-above.

As depicted in FIG. 1, none of the two cylinders is able to rotate along the shear line 3. This is because there is no key present in the lock which key could unlock locking mechanism 30 or 31. Each locking mechanism in this embodiment comprises multiple pins 300, forced to take a position towards the cylinder by springs 301. Of these pins, one pin is numbered in FIG. 1, namely the inner most pin of the left cylinder 1. This pin is divided into a first sub-pin 300A and a second sub-pin 300B. In the un-locking position, when a key (not shown) is placed into one of the cylinders, the transitions sites of each sub-pin combination is exactly located at the shear line 3 as commonly known in the art. This way, the cylinder may freely rotate in its housing and the cam may actuate the closing element.

This lock according to the invention has a blocking element 20 positioned between the first and second end 11 and 12 of the cylinder 1. This cylinder corresponds to the outside of the house-door and is thus prone to unwanted opening by burglars or the like. In the configuration shown, the element 20 has a peg-shape that is congruent to the shape of any of the sub-pin combinations (and therefore fits a hole drilled like any of the holes that are provided with these pins). In the configuration shown, the blocking element blocks the keyway (see FIG. 2) and thus prevents that any key can be put any further in the keyway that passed the outermost sub-pin combination. The blocking element is very hard to drill out since it cannot easily be reached and has a convex surface. By actuating the configuration means, which comprise spindle 21 and motor 22 (which motor has an internal battery, not shown), the blocking element 20 can be translated in a direction perpendicular to the longitudinal direction in which the cylinder 1 extends. This way, the blocking element 20 can be moved towards the motor 22 (see FIG. 3) and be retracted such that it is completely above shear line 3. This way, a key can freely enter the keyway while at the same time the cylinder is not prevented from rotation by the blocking element 20.

The motor 22 is actuated by receiving a control pulse from central processing unit 23. This processing unit 23 on its turn is provided with a chip (receiver) that is able to receive a radio pulse 600 sent by a remote control unit 505, which unit is provided with an RFID chip in this embodiment. In this specific embodiment, only a transmitter chip that is programmed to correspond to this lock is able to transmit the proper signal 600 whereupon the CPU 23 acts to configure blocking element 20 in its "open" position. This way, the configuration means is controllable by wireless communication between the lock and the remote control unit

FIG. 2

Figure 2:
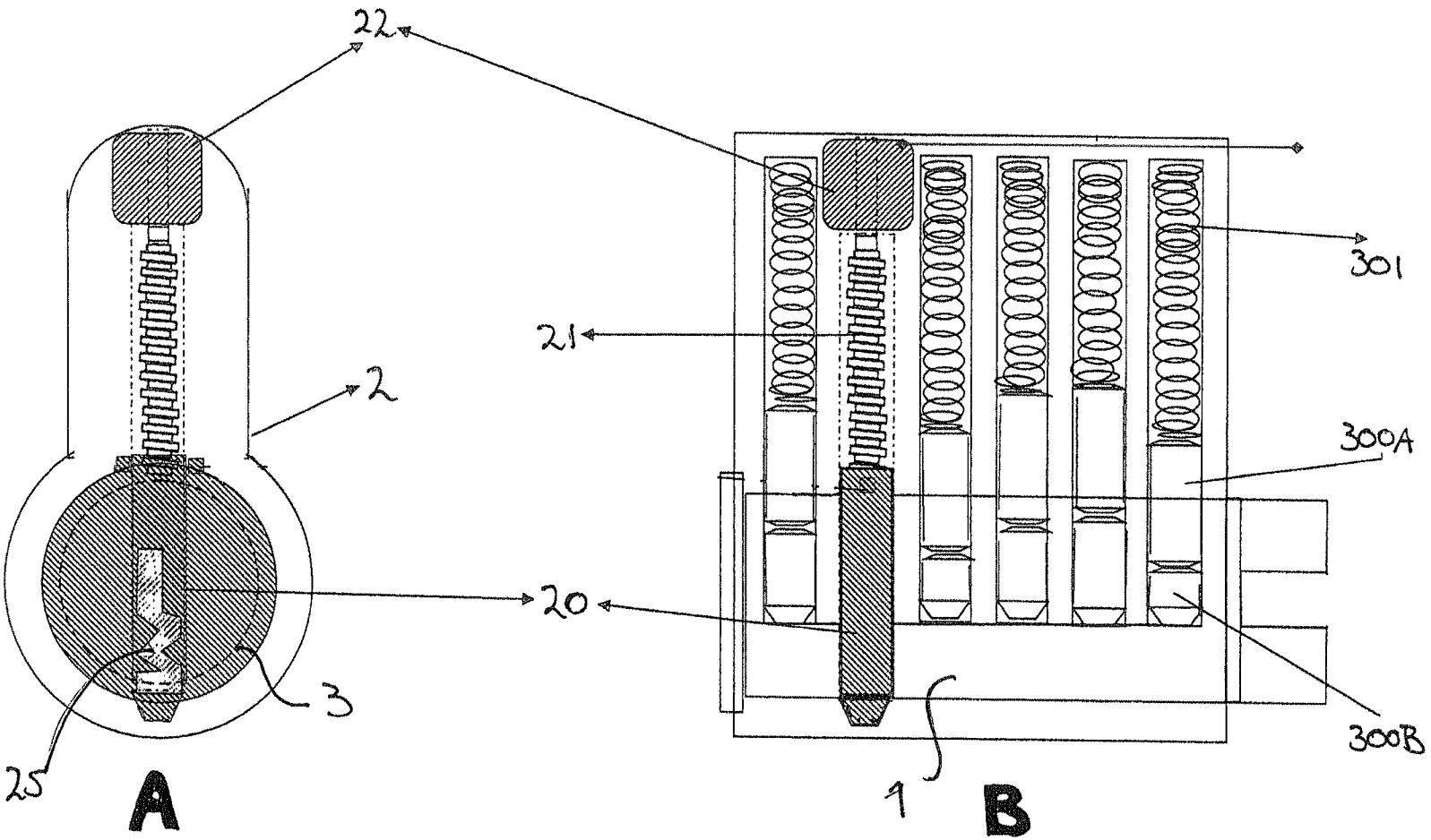
FIG. 2 schematically shows a front view and a cross-sectional view of a cylinder lock FIG. 3 schematically shows a front view and a cross-sectional view of the cylinder lock of FIG. 2, with a key placed in the cylinder FIG. 4 schematically shows a second embodiment of a blocking element and its configuration in a cylinder lock FIG. 5 schematically shows a chip key

FIG. 2 schematically shows a front view (part A) and a cross-sectional view (part B) of a cylinder lock according to the invention. Part B of FIG. 2 shows the essential parts of a single cylinder lock. The numerals refer to parts that correspond to the parts as shown in FIG. 1. The A part shows the same parts in front view. This view shows the keyway 25, i.e. at least the entrance of that key way, milled in entrance element 5.

FIG. 3

Figure 3:
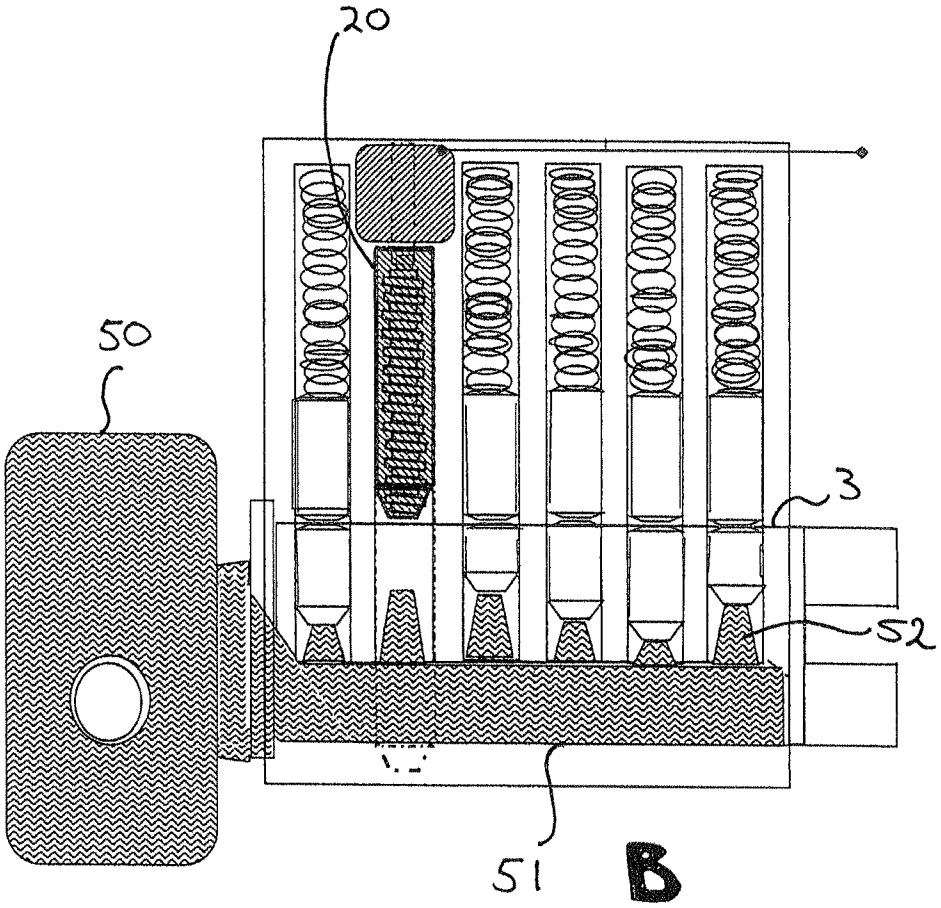
Figure 3:
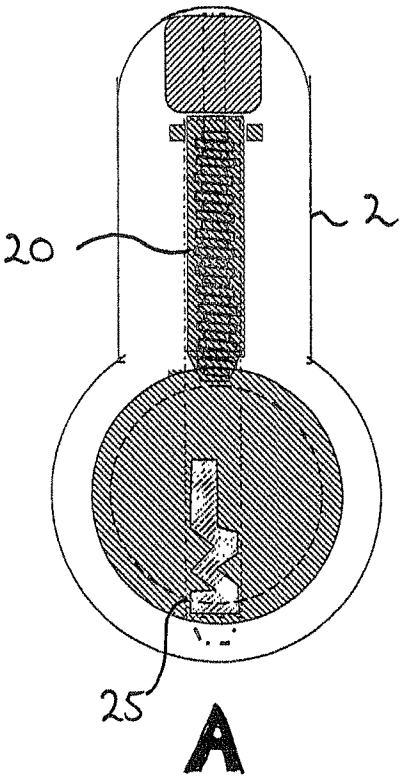

FIG. 3 schematically shows a front view (part A) and a cross-sectional view (part B) of the cylinder lock of FIG. 2, with a key 50 placed in the cylinder. As can be seen in part B, the blocking element 20 is in its most upward position, retracted completely into the housing. Key 50 is placed in the cylinder, its blade 51, through its bitings 52, cooperating with the sub-pin combinations as shown. This way, the sub-pin combinations are brought in the unlock position wherein the transition sites coincide with shear line 3.

In this embodiment the lock is provided with a contact (not shown) that corresponds to an element of the key (such as a dimple, contact, biting, chip etc.). When the contact is activated, thus when the key is placed in the keyway, this de-activates the configuration means in order to prevent that the blocking mechanism is activated when the key is placed in the lock.

FIG. 4

Figure 4:
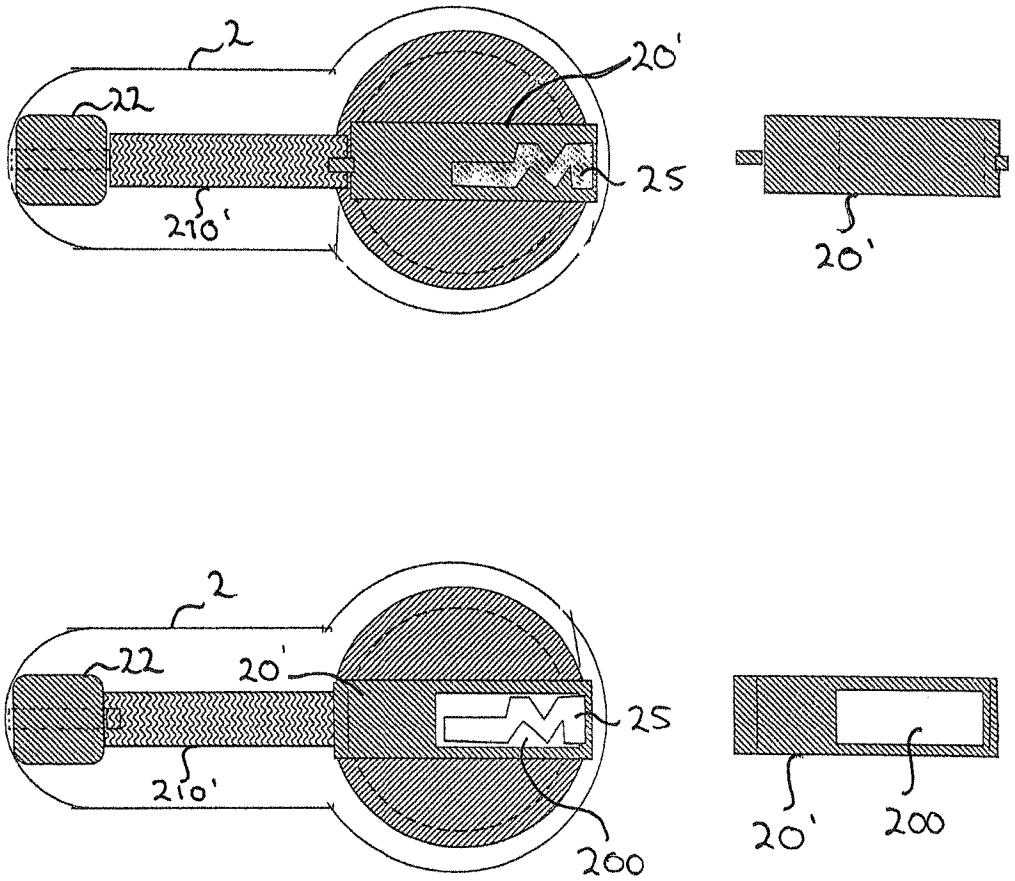

FIG. 4 schematically shows a second embodiment of a blocking element and its configuration in a cylinder lock, in the first (keyway blocked) position (part A) and second (keyway open) position (part B). To begin with the latter, as can be seen in FIG. 4B, the blocking element 20' has a hole 200 machined therein. This hole is large enough to overlap the keyway cross-section. This overlap can be seen in the left diagram of FIG. 4B. In this diagram, the blocking element is rotated in the housing 2 such that the hole 200 matches the keyway 25. This way, a matching key can be placed in the cylinder without problems. Using configuration means 22 and 210', the blocking element is configurable by rotation about an axis that extends in a direction perpendicular to the longitudinal direction in which the cylinder extends (in this embodiment, means 210' is provided with a slotted end in which means 22 grasps). This way, the blocking element can be put in a configuration wherein the keyway 25 is blocked, an example of which configuration can be seen in part A of FIG. 4 (it is noted that in this embodiment the blocking element is turned over an angle of 90° to close the keyway completely, but in order to make use of the invention the blocking element need not completely close the keyway to prevent entry of the key, a turn over 45° for example could also be sufficient to effectively block the keyway and prevent entry of a key). By keeping the coupling between blocking element 20' and configuration means 210' in all configurations, except for the configuration as depicted in part B, this coupling may additionally prevent that the cylinder is rotated in its housing.

FIG. 5

Figure 5:
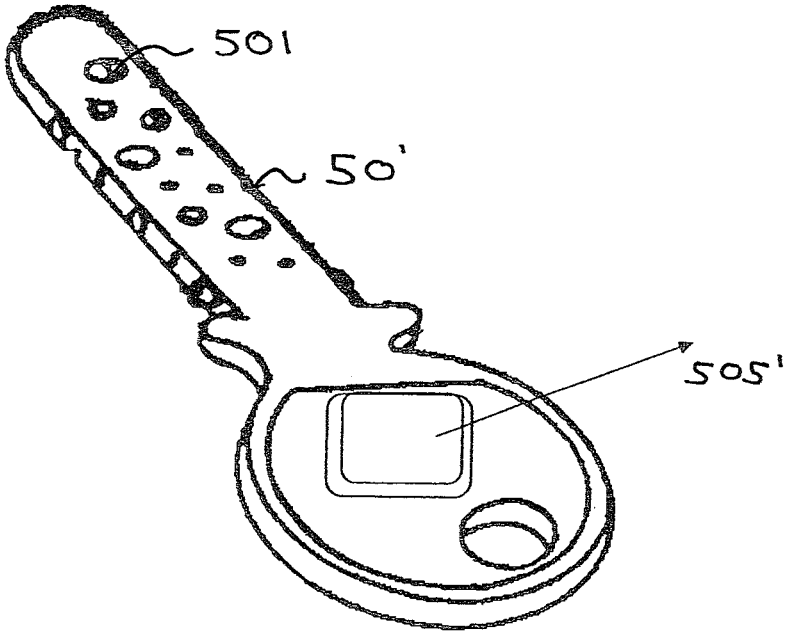

FIG. 5 schematically shows a chip key 50' for use in the present invention. This chip key has a blade that is provided with dimples 501 for use in a so-called dimple-lock. The key is provided with an RFID chip 505' that may transmit a signal or interfere with a transmitted signal, such that a return signal can be used according to the invention.

In an advantageous embodiment, a key for use with the lock according to the present invention is a key is made from durable polyamide. The integration of a (RFID) chip is easy provide in this material, by introducing the chip in the key when being injection moulded at 120° C. (Nylon 66). Against the traditional positioning of a chip in a key (viz. the chip being present in the handle/pad of the key), the chip is present in the blade, in particular near the distal end (opposite the handle) of the blade.

What is claimed is:

1. Cylinder lock comprising:

a housing, a cylinder rotatably provided in the housing and having a first end and a second end, the cylinder extending in a longitudinal direction between the first end and the second end, the cylinder comprising an internal keyway for placing a key corresponding to the lock in the cylinder, a locking mechanism that prevents rotation of the cylinder with respect to the housing when the key is not present in the keyway, wherein the locking mechanism comprises multiple pins, a blocking element positioned between the first and second end, which blocking element is configured to take a first position wherein the keyway is blocked to prevent complete entry of a key into the keyway and a second position wherein the keyway is unblocked to permit complete entry of a key into the keyway, wherein the blocking element in the first position prevents rotation of the cylinder with respect to the housing, the blocking element and each of the pins are of congruent shape, the blocking element is at a position of the pin closest to the first end, and a configuration device in the housing to configure the blocking element in the first or second position.

2. Cylinder lock according to claim 1, wherein the blocking element is peg-shaped.

3. Cylinder lock according to claim 1, wherein the blocking element is configured by translation in a direction perpendicular to the longitudinal direction in which the cylinder extends.

4. Cylinder lock according to claim 1, wherein the blocking element is configured by rotation about an axis that extends in a direction perpendicular to the longitudinal direction in which the cylinder extends.

5. Cylinder lock according to claim 1, wherein the lock comprises a power source to provide power to actuate the configuration device.

6. Cylinder lock according to claim 5, wherein, when the power source has a power to actuate the configuration device below a predetermined minimum level, the blocking element takes a default position.

7. Cylinder lock according to claim 1, further comprising a remote control to control the configuration device by wireless communication.

8. Cylinder lock according to claim 7, wherein the remote control unit is operatively connected to the key.

9. Cylinder lock according to claim 7, wherein the key is provided with a transmitter that is able to send a signal to provide said communication.

10. A combination of a cylinder lock according to claim 7 and a key that corresponds to said lock, wherein the key is provided with a transmitter and the lock is provided with a receiver, and said transmitter and receiver enable the wireless communication.

11. Cylinder lock comprising:

a housing, a cylinder rotatably provided in the housing and that comprises an internal keyway for placing a key corresponding to the lock in the cylinder, a locking mechanism that prevents rotation of the cylinder with respect to the housing when the key is not present in the keyway, the locking mechanism comprising multiple separate locking elements, a blocking element positioned in lieu of one of said locking elements, which blocking element is configured to take a first position wherein the keyway is blocked and a second position wherein the keyway is unblocked, and a blocking element positioned in lieu of one of said locking elements, which blocking element is configured to take a first position wherein the keyway is blocked to prevent complete entry of a key into the keyway and a second position wherein the keyway is unblocked to permit complete entry of a key into the keyway, wherein the blocking element is positioned in lieu of the locking element that is situated adjacent an entrance of the keyway, and a configuration device in the housing to configure the blocking element in the first or second position.

12. Cylinder lock according to claim 11, further comprising a remote control to control the configuration device by wireless communication.

* * * * *